US006112556A

United States Patent [19]

Roth

[11] Patent Number: 6,112,556

[45] Date of Patent: Sep. 5, 2000

[54] KNITTING TOOL AND METHOD OF MAKING THE SAME

[75] Inventor: Richard Roth, Albstadt, Germany

[73] Assignee: Groz-Beckert KG, Albstadt, Germany

[21] Appl. No.: 08/956,778

[22] Filed: Oct. 23, 1997

[30] Foreign Application Priority Data

Oct. 24, 1996 [DE] Germany ..... 196 44 166

[51] Int. Cl.[7] ..... D04B 35/02

[52] U.S. Cl. ..... 66/123; 66/116; 66/121

[58] Field of Search ..... 66/116, 119, 120, 66/121, 122, 123, 124; 72/414, 415

[56] References Cited

U.S. PATENT DOCUMENTS

| | | | |
|---|---|---|---|
| 3,748,875 | 7/1973 | Slof et al. | 66/123 |
| 4,036,036 | 7/1977 | Ashmead et al. | 66/123 |
| 4,151,783 | 5/1979 | Zimmermann . | |
| 4,417,454 | 11/1983 | Berentzem . | |
| 5,094,091 | 3/1992 | Treuz et al. | 66/123 |
| 5,327,748 | 7/1994 | Izumi et al. | 66/123 |
| 5,509,280 | 4/1996 | Schuler et al. | 66/121 |
| 5,582,038 | 12/1996 | Braun et al. . | |

FOREIGN PATENT DOCUMENTS

| | | |
|---|---|---|
| 29 11 195 | 3/1981 | Germany . |
| 26 37 078 | 12/1981 | Germany . |
| 34 01 874 | 7/1985 | Germany . |
| 44 42 943 | 5/1996 | Germany . |

*Primary Examiner*—Danny Worrell
*Attorney, Agent, or Firm*—Venable; Gabor J. Kelemen

[57] ABSTRACT

A method of making a knitting tool for a textile machine includes the following steps: stamping a knitting tool blank from stock material, wherein the stamped blank has, at an outer periphery thereof, a sharp burr and/or a sharp edge resulting from the stamping step; and submitting the stamped blank to an embossing step for rounding and/or chamfering the sharp burr and/or the sharp edge, whereby the sharp burr and/or the sharp edge is at least partially eliminated by embossing.

9 Claims, 6 Drawing Sheets

KNITTING TOOL AND METHOD OF MAKING THE SAME

CROSS REFERENCE TO RELATED APPLICATION

This application claims the priority of German Application No. 196 44 166.8 filed Oct. 24, 1996, which is incorporated herein by reference.

BACKGROUND OF THE INVENTION

This invention relates to a method of making knitting tools from a stamped blank. Further, the invention relates to a stamped knitting tool for textile machines and is of the type having rounded, chamfered or fractured edges. By "knitting tool" there are meant, for example, latch needles, spring-beard needles, compound needles, latchless needles (such as plush hooks for making plush wear) as well as sinkers.

Knitting tools of the above-outlined type have to be manufactured in most cases in large quantities and have to be of uniform, good quality. Such requirement pertains particularly to those edges of the knitting tools which contact the thread to be knitted or which are in contact with walls of guide channels or needle channels and move relatively thereto.

German Patent No. 2,637,078, to which corresponds U.S. Pat. No. 4,151,783, discloses a method and an apparatus for machining the butt of stamped knitting machine needles. Starting from a stamped component, the stamped butt edges are machined by cutting in a milling process for obtaining the desired butt shape. The needle butt may be rounded or chamfered at its upper or lower edges contacting the cam of the knitting machine.

German Patent No. 2,911,195, to which corresponds U.S. Pat. No. 4,417,454, also relates to the shaping of the needle butt. According to this reference, the needle butt is provided in an embossing step with groove-like depressions which extend over the entire length of the needle butt on the flat sides thereof. An embossing tool provided for this purpose receives the butt of a needle stamped from a steel ribbon (stock material) and, as the tool is closed, it presses the above-noted grooves into the flat sides of the needle butt. The fractured surfaces appearing upon the stamping of the needle butt are in this manner squeezed outwardly and changed into a predetermined shape. The remainder of the needle is not affected by the embossing process.

German Patent No. 4,442,943, to which corresponds U.S. Pat. No. 5,582,038, describes a stamped knitting tool which has a butt provided with plastic-filled apertures. In the essentially strip-shaped blade longitudinal, slot-like openings are provided whose peripheral edges on both sides of the openings are pinched to permit a form-locking securement of the plastic filling. During such a pinching operation the peripheral edges are, from both sides of the flat, strip-like blade, pressed towards one another, whereby the material flowing towards one another deforms the wall of the slit-shaped opening. Between the thus-chamfered edges of the opening the slot wall is of concave configuration.

According to German Offenlegungsschrift 34 01 874, in the manufacture of welt hooks, embossing and stamping steps are combined for shaping the needle blade. According to this method, particularly the depressions to be provided in the needle blade are, before stamping of the needle blade, embossed into the metal ribbon, involving the displacement of material. The stamping step which determines the dimensions of the needle is thus performed subsequently to maintain the needle at the desired coarse (preliminary) outer contour. Fractured edges are subsequently eliminated or taken into consideration.

SUMMARY OF THE INVENTION

It is an object of the invention to provide an improved knitting tool and an improved manufacturing method therefor to avoid or eliminate sharp edges or burrs.

This object and others to become apparent as the specification progresses, are accomplished by the invention, according to which, briefly stated, one method of making a knitting tool for a textile machine includes the following steps: stamping a knitting tool blank from stock material, wherein the stamped blank has, at an outer periphery thereof, a sharp burr and/or a sharp edge resulting from the stamping step; and submitting the stamped blank to an embossing step for rounding and/or chamfering the sharp burr and/or the sharp edge, whereby the sharp burr and/or the sharp edge is at least partially eliminated by embossing. Another method of making a knitting tool for a textile machine includes the following steps: stamping a knitting tool blank from stock material; embossing a groove into the knitting tool blank, wherein the groove has at least in sections rounded and/or chamfered terminal flanks; and after the stamping step, shaping the groove by a cutting step to form a depression or a sawslot.

The common, basic principle in both methods resides in that the edge zones are, by an embossing operation, rounded, chamfered or otherwise fractured before or after a usual shaping process, such as milling or stamping.

According to one method of the invention, a sharp edge or burr obtained by stamping the blank is eliminated by an embossing step. For this purpose, the stamped blank is positioned into the engraved (patterned) die of an embossing tool and is embossed therein. The engraved die, that is, the receiving space of the embossing tool for the blank is dimensioned such that projecting or sharp edges of the blank are pressed in, whereby in the edge region a flow of material occurs towards the middle of the blank. The edge region and the adjoining surface zones which are also affected by the shaping process are reinforced in this manner. Such a process improves the service life of the needle.

The embossing process relatively accurately determines the geometry of the knitting tool. The cross section of the knitting tool is defined by and corresponds to the shape of the engraved pattern of the embossing tool. In particular, in the edge zone oblique surfaces or chamfers (bevels) may be formed. The edge geometry obtained by the embossing process provides for significantly improved sliding properties of the chamfered knitting tools in the corresponding guide channels of knitting machines. As compared to conventional polishing or grinding processes for eliminating burrs, by means of the embossing step according to the invention better reproducible contours are obtained. The knitting tools have a lesser tendency to damage the channel walls and further, they displace the lubricant to a lesser extent.

While in principle it is sufficient to submit the stamped blank only in sections to the embossing process, in addition to the regions (edges) to be chamfered, adjoining zones, such as the flat sides of the blank are expediently also embossed. In this process the embossing tool preferably accommodates the entire stamped blank so that it is embossed in its entirety. As a result, the knitting tool and also, the zone of the tool butt (if present) is surface-reinforced and, at the same time, de-burred.

The inherently unsymmetrical cross section relative to the longitudinal central plane of the stamped blank is, by virtue of the invention, transformed after the stamping operation into a substantially symmetrical, convex shape. In addition to the burrs, fractured surfaces are smoothened. This is of particular advantage for tool regions which are exposed to high surface stresses in use. This reduces fissure formation (which usually occurs after longer use) to thus increase the service life of the knitting tool.

The embossing process may give the stamped blank a shape which excludes the possibility of damages to the yarn to be knitted by the knitting tool. The embossing step may be performed, as noted above, after the stamping of the blank to dull any sharp edges, but may also be performed before a machining (such as chip removing) operation. Such a procedure is of significance, for example, in the manufacture of latch needles in which a sawslot has to be formed in the needle cheek for receiving a movably supported needle latch. The sawslot is conventionally milled into the blank, as a result of which sharp edges are obtained at the rim of the milled sawslot. With the method according to the invention, first at least one groove having oblique flanks is embossed into the blank. The groove bottom is deepened by the successive milling step such that the groove bottom is broken through. The flanks of the embossed groove then form the rim of the sawslot which is thus free from sharp edges. While in case of a conventional polishing or grinding process the edges of the slot are essentially inaccessible because of the narrow sawslot dimensions, by means of the embossing step an effective edge-rounding is achieved.

The embossing step may be performed on opposite narrow sides of the needle blank so that the slot to be formed has a rounded periphery on both sides.

The embossing process results in a reinforcement of the material of the knitting tool in the region of the slot rim which has particular significance in latch needles. The latch which is pivotally supported in the sawslot swings in synchronism with the needle motion from one end position (terminal abutment) to the other. Because the needle cylinder of circular knitting machines rotates, such a rotary motion is superposed on the longitudinal needle motion, and thus the rapidly opening and closing needle latch is alternatingly pressed to the opposite sawslot flanks by virtue of the Coriolis force. The material surface reinforced by the embossing prevents an excessive wear which would otherwise enlarge the lateral play of the latch. In case such play exceeds the maximum permissible dimension, risks are high that the latch jams at the needle head (hook) which renders the needle useless.

The embossing step may be performed with two embossing punches or with suitably profiled rollers. The tools are mechanically or electronically cam-guided or they are pressed with a predetermined force on the needle blank whereby the desired depth of penetration is set by itself.

In the embossing of the outer edges as well as in the embossing of the slot edges the respective outer contour of the knitting tool may be set by shaping without a cutting operation (that is, without material removal). The direction of embossing, that is, the main direction in which material is moved in the region of the edges to be chamfered, is aligned approximately with the middle of the cross section of the knitting tool in both embossing processes.

A stamped knitting tool has, on its outer contour, particularly in the edge region, at least one embossing zone which is free from sharp edges. If the embossing zones form the outer edges of the knitting tool, then the knitting tool runs with low friction in the associated guide channels and treats the thread gently in the gliding zone therefor.

In case the knitting tool is a knitting machine needle having a butt, then the embossing step, particularly in the transitional region between the needle butt and the blade, can eliminate fractured edges by strengthening the material. If, during the stamping operation of the blank in this region first the sharp edges are eliminated by embossing, the microfissures in the edge zones are rendered ineffective which otherwise would reduce the dynamic strength of the knitting tool.

DESCRIPTION OF THE PREFERRED EMBODIMENTS

Figure 1:
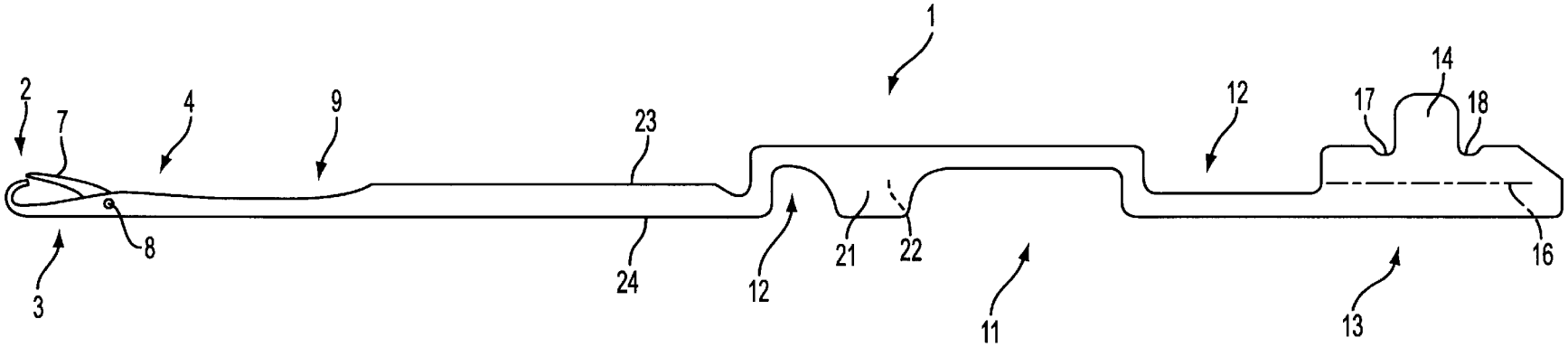
FIG. 1 is a schematic side elevational view of a latch needle.

Turning to FIG. 1, a latch needle 1 which serves as a knitting tool has a head or hook 2 adjoined by a throat 3 which, in turn, is adjoined by a needle cheek 4. In the needle cheek 4 a longitudinal sawslot 6 is provided in which a needle latch 7 is arranged for pivotal motion about a latch bearing 8.

The needle cheek 4 is adjoined, with the intermediary of a groove 9, by a blade 11 which, during operation, is received in a needle channel of the knitting machine. The blade 11 which is provided with a plurality of recesses 12 giving the blade a meandering configuration, has a butt 14 at its end 13 opposite the hook 2. The butt 14 is formed as a one-piece member with the blade 11 and extends perpendicularly to the longitudinal direction 16 of the latch needle 1. The periphery of the butt 14 passes over to the blade 11 at arcuate transitional zones 17, 18.

Figure 3:
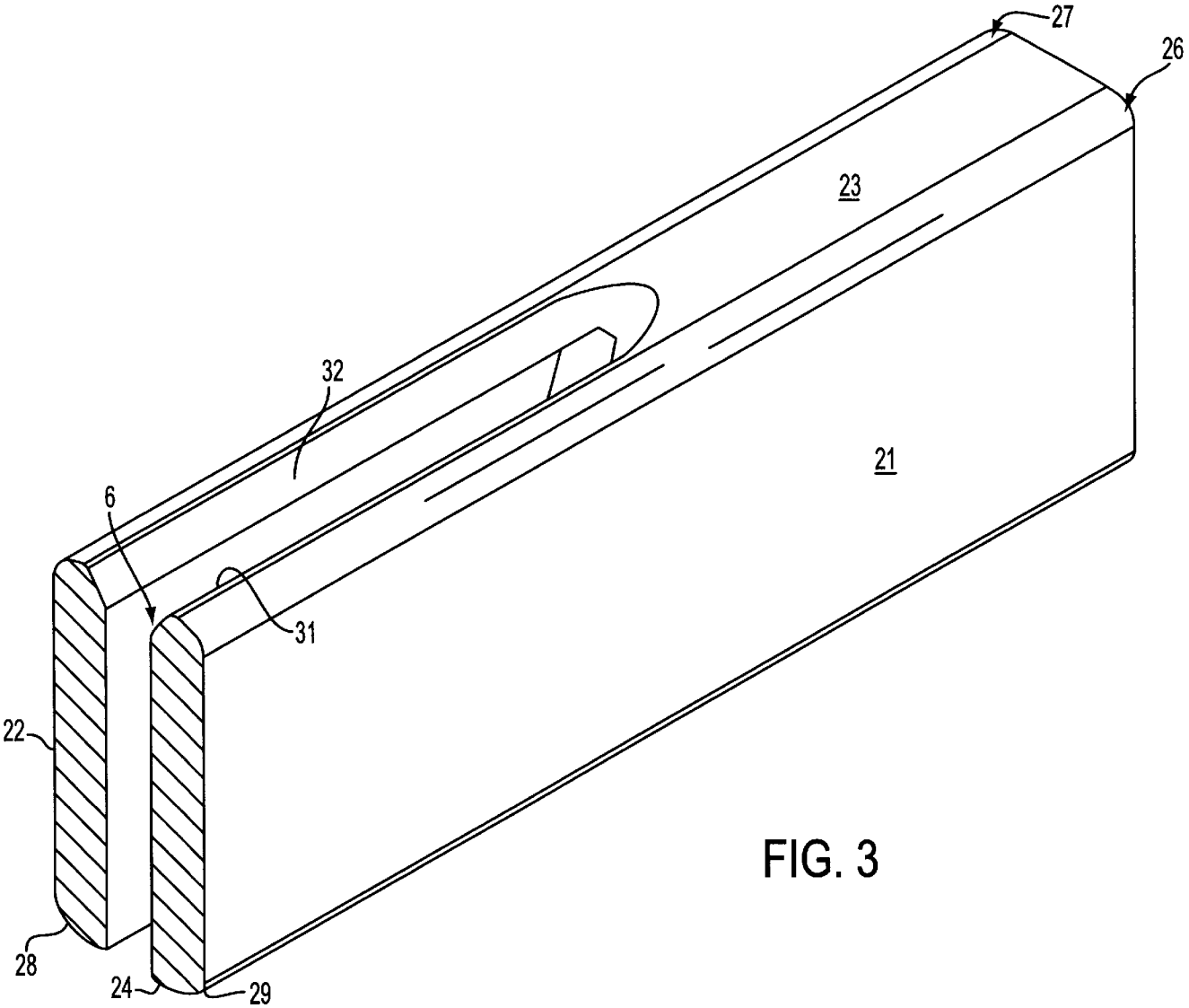
FIG. 3 is a simplified perspective fragmentary view of the cheek region of a latch needle on an enlarged scale relative to FIGS. 1 and 2.
Figure 6:
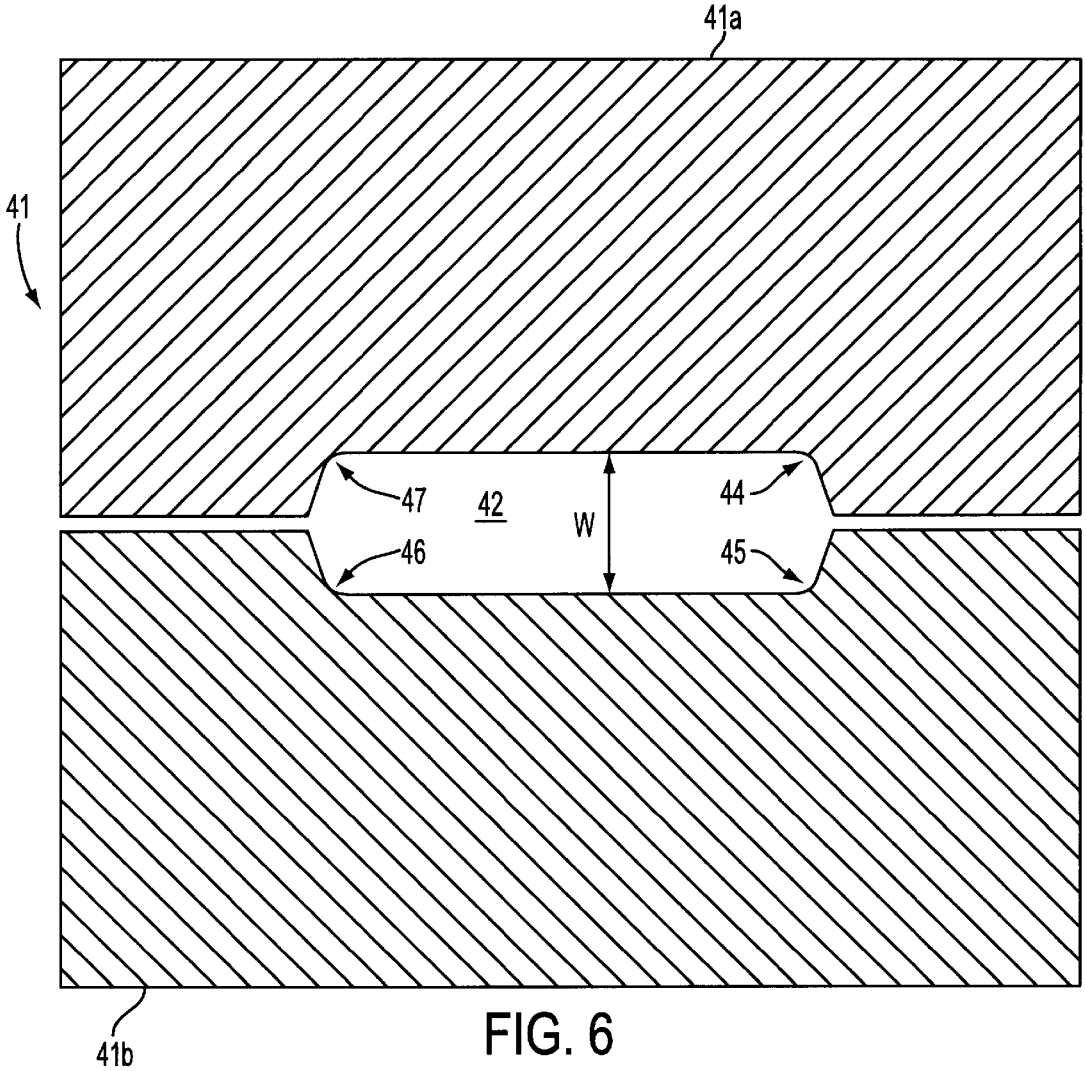
FIG. 6 is a sectional end elevational view of an embossing tool for performing an embossing operation on the needle blank shown in FIG. 4.

The latch needle 1 has two opposite, parallel, relatively wide side faces 21, 22 between which relatively narrow, opposite edge faces, that is, the upper needle face 23 and the needle back 24 are located. Also referring to FIG. 3, between the upper needle face 23 and the side faces 21, 22 transitional regions 26 and 27 are provided which are slightly rounded and thus form a transition which is void of sharp edges. Corresponding transitional regions 28, 29 are provided between the needle back 24 and the side faces 21, 22.

The opening of the sawslot 6 at the upper needle face 23 is bordered by oblique flanks 31, 32 which form, without sharp edges, zones of transition to the upper needle face 23. Similar oblique flanks 54, 55 (FIG. 8) may be provided at the bottom opening of the sawslot 6, that is, at the region of transition to the needle back 24.

Figure 2:
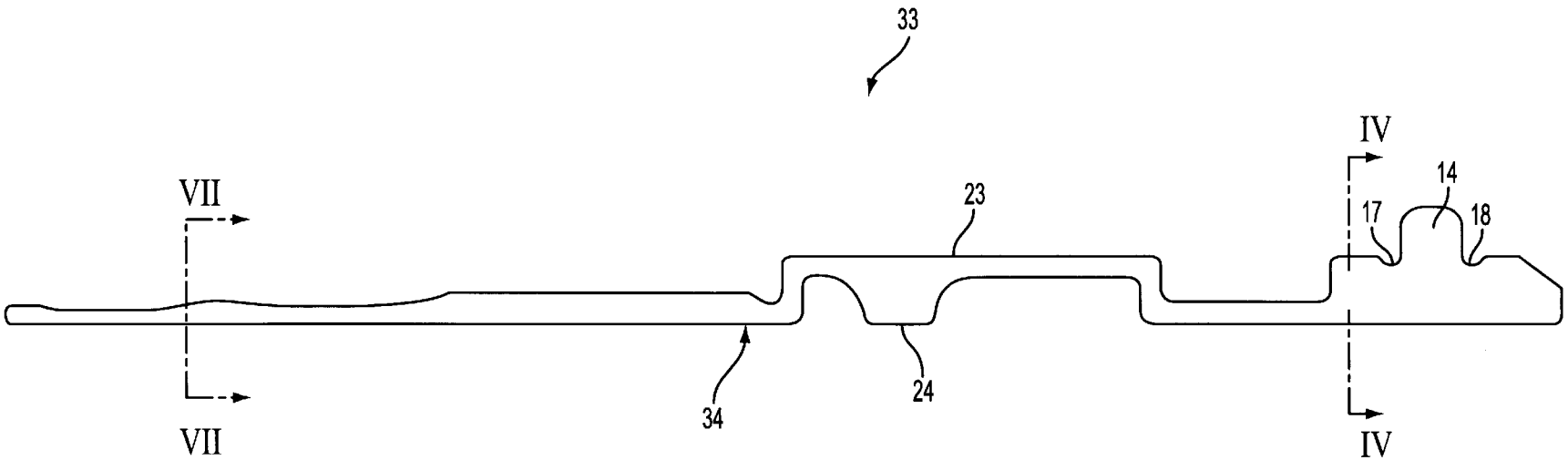
FIG. 2 is a schematic side elevational view of a needle blank from which the needle of FIG. 1 is made.
Figure 4:
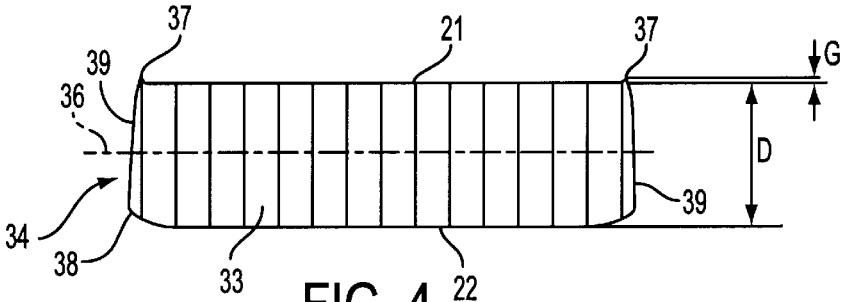
FIG. 4 is an enlarged schematic sectional end view of a needle blank prior to an embossing operation.

The initial, starting component in making the latch needle 1 is a needle blank 33 which is shown in FIG. 2 and which has been stamped out of a thin steel ribbon (stock material). The contour 34 of the needle blank 33 is essentially determined by the stamping tool and includes the side faces 21, 22 (also shown in FIG. 4) as well as the upper needle face 23 and the needle back 24. The needle blank 33, in its state after stamping from the steel ribbon, is asymmetrical relative to the longitudinal central plane 36 which extends parallel to the side faces 21, 22. While along the contour 34 at the upper face as shown in FIG. 4 the needle blank 33 has burrs 34, the side 38 is rounded. The fractured surfaces 39 lying therebetween are not planar and in most cases are not exactly perpendicular to the side faces 21, 22.

Also referring to FIG. 4, to remove at least the burr 37 which projects by a burr height G beyond the side face 21 an embossing tool 41 is used which is composed of an upper tool 41*a* and a lower tool 41*b* and by means of which the stamped blank 33 is converted into an embossed blank 33*a*. A die 42 which has an engraved pattern is formed in the embossing tool 41 and corresponds in shape to the embossed blank 33*a* from which the base body of the latch needle 1 is formed. In the closed position of the embossing tool 41 the inner clearance W of the die 42 of the embossing tool 41 corresponds to or is slightly less than the thickness D of the stamped blank 33.

Figure 5:
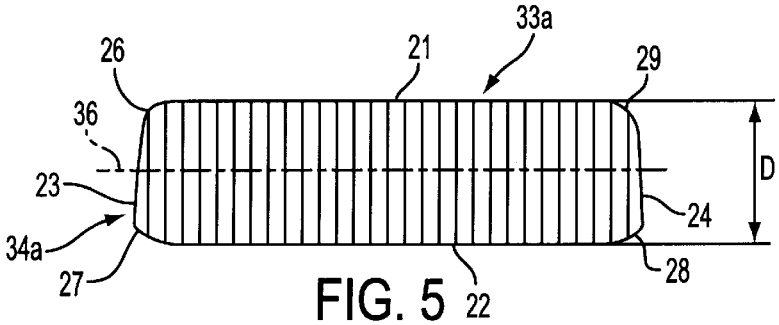
FIG. 5 is a view similar to FIG. 4, showing the construction subsequent to the embossing operation.

To obtain a desired edge deformation of the stamped blank 33, rounded edge portions 44, 45, 46 and 47 are provided in the upper tool 41*a* and the lower tool 41*b* along the border of the engraved pattern of the die 42. Otherwise the die 42 is bounded by planar faces. A stamped blank 33 positioned in the die 42 is therefore, when the embossing tool 41 is closed, deformed particularly in the region of its outer edges whereby its thickness D remains essentially unchanged. The stamped blank 33 is transformed into a configuration (that is, into the embossed blank 33*a* having an outer contour 34*a*) which is essentially symmetrical relative to its longitudinal central plane 36 as shown in FIG. 5. Both the burrs 37 and the side 38 of the stamped blank 33 are deformed in the course of the embossing step by means of the embossing tool 41, whereby the transitional regions 26, 27, 28, 29 are formed with radii which are determined by the edge regions 44 to 47 of the die 42. The direction of material flow is, related to the cross-sectional surface shown in FIGS. 4 and 5, approximately diagonal to the middle of the cross section.

A more pronounced deformation of the stamped blank 33 is possible where the fractured faces 39 are smoothened by virtue of the flow of material. Independently therefrom, burr-free, positively rounded or chamfered, strengthened edge regions are obtained by the embossing operation. This applies for the edges in the yarn gliding region of the throat 3, the cheek 4 and the groove 9 as well as to the edges of the blade 11. The edge-rounding in the thread gliding region improves the properties of the latch needle 1 as far as handling of the yarn during the knitting operation is concerned. The rounding of the edges of the blade 11 improves the gliding properties of the latch needle 1 in the needle channel. The obtained surface strengthening is of advantage in either case.

The embossing operation positively affects particularly the dynamic strength of the butt 14. This is achieved by embossing particularly the arcuate transitional zones 17 and 18 between the blade 11 and the butt 14. The respective surfaces and edges are throughout smoothened or rounded and, as result, the butt 14 is capable of withstanding higher continuous dynamic loads. During the embossing operation microscopic surface irregularities are eliminated and the surface is smoothened particularly in the regions of the transitions 17, 18.

Figure 8:
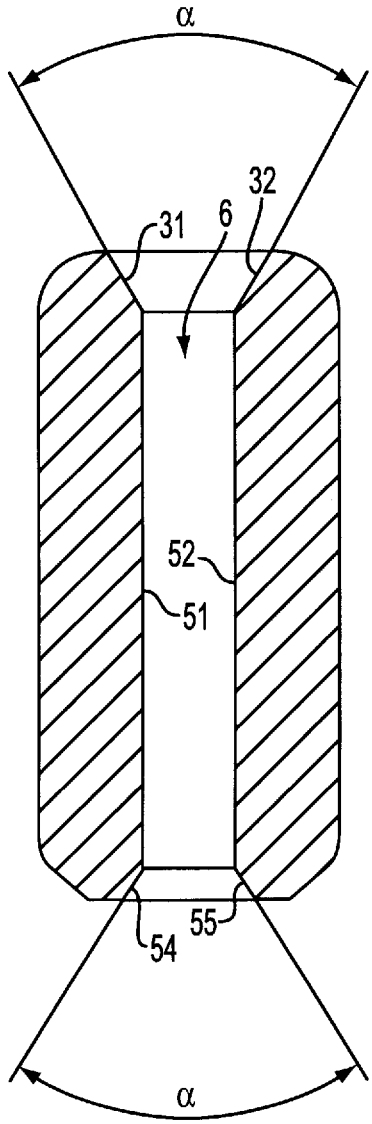
FIG. 8 is a schematic sectional end elevational view of a needle blank according to FIG. 7, showing a longitudinal sawslot in the needle cheek.

During the subsequent operation the sawslot 6 is formed in the embossed blank 33*a*. For rounding or blunting the edges bounding the sawslot 6, an embossing step performed on the needle cheek is included in the manufacturing sequence for making the latch needle 1. In its mid zone, the sawslot 6 shown in FIG. 8 is bounded by two mutually parallel sawslot flanks 51, 52 adjoined at the upper needle face 23 of the latch needle 1 by the oblique faces (flanks) 31, 32. Likewise, at the needle back 24 oblique flanks 54, 55 are formed which, similarly to the oblique flanks 31, 32, form an acute angle $\alpha$ of, for example, 60° with one another. The oblique flanks 31, 32; 54, 55 shown as planar, may be rounded or may be arranged at another angle to one another.

Figure 7:
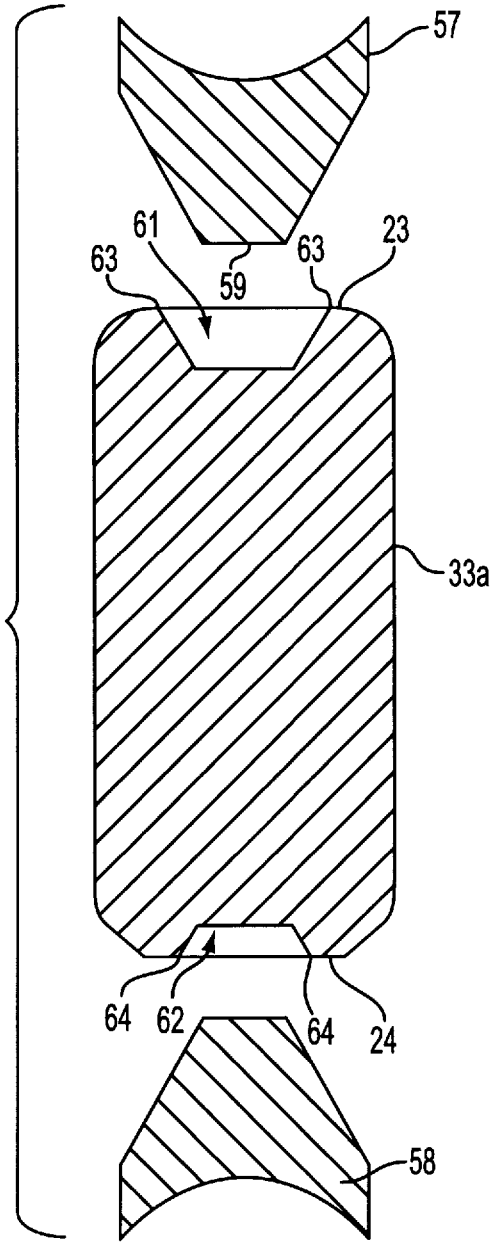
FIG. 7 is a schematic sectional end elevational view on an enlarged scale of the needle blank shown in FIG. 2, prior to forming a longitudinal slot (sawslot) and subsequent to an embossing operation.
Figure 9:
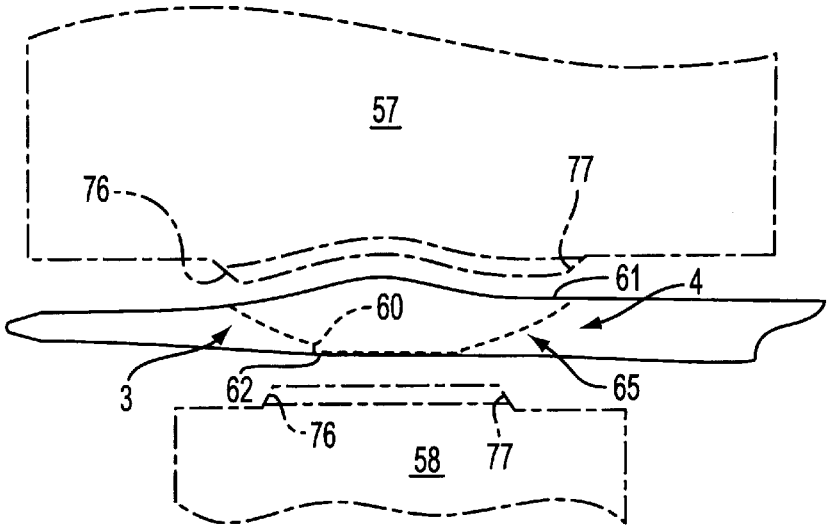
FIG. 9 is a schematic side elevational view of an apparatus for embossing a latch needle.

Turning to FIGS. 7 and 9, the embossing punches 57 and 58 serve for forming the oblique flanks 31, 32; 54, 55. The upper embossing punch 57 which is conformed in its longitudinal direction to the curvature of the embossed blank 33*a* in the region of the throat 3 and the cheek 4, has a trapezoidal cross section with a narrow end face 59 whose width is slightly less than the distance of the sawslot flanks 51 and 52 from one another. The cooperating lower embossing punch 58 has a trapezoidal cross section as well, but is of straight configuration corresponding to the needle back 24.

The embossing punches 57 and 58 are moved towards the embossed blank 33*a* held therebetween and press a cross-sectionally trapezoidal longitudinal groove 61, 62 in the upper needle face 23 and the needle back 24, respectively. The edges 63 and 64 provided during this step in the transitional zone to the upper needle face 23 and the needle back 24 are not sharp but rounded. The outer contour 34*a*, together with the external transitional regions 26, 27, 28 and 29 and the edges 63 and 64, is defined exclusively by means of shaping steps which do not involve material removal (cutting).

After completion of the embossing process, one half of the sawslot 6 is milled, starting from the longitudinal groove 61, to the vicinity of the longitudinal groove 62, as a result of which first a thin sawslot bottom remains. In a consecutive stamping operation the sawslot bottom is broken through to obtain a throughgoing passage 60. The sawslot 6 obtained in this manner has a contour such as shown at 65 in FIG. 9. By pre-forming the longitudinal grooves 61, 62 before providing the sawslot 6 with the cutting operation proper, not only the sawslot edges are broken off or rounded but also the material at the sawslot rim is strengthened. In this manner the edges of the sawslot 6 designed to receive and support the needle latch 7 are less prone to wear under the effect of the blows delivered by the back-and-forth snapping needle latch 7.

Furthermore, knitting machine needles are known which have no throughgoing aperture 60 and thus in their manufacture the last-named stamping operation and the embossing of the longitudinal slot 62 are omitted.

Figure 10:
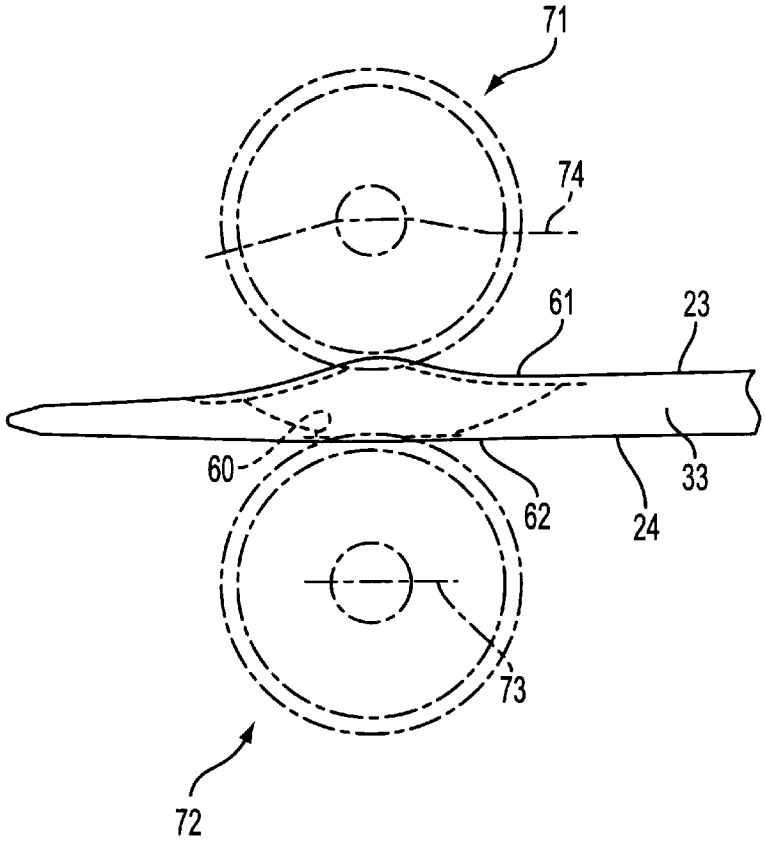
FIG. 10 is a schematic side elevational view of another apparatus for embossing a latch needle.

Turning to FIG. 10, instead of the embossing punches 57, 58 rollers 71, 72 may be used which have a trapezoidal pattern on their cylindrical surface. For forming the longitudinal grooves 61, 62, the blank 33, 33*a* is guided between the rollers 71 and 72 in such a manner that the rollers press into the upper needle face 23 and the needle back 24 or the rollers 71, 72 are guided along the blank 33, 33*a*. During such an operation the roller 72 moves on a linear track 73 while the roller 71 is guided along a curvilinear path 74 corresponding to the needle contour. After forming the grooves 61, 62 the subsequent shaping is performed as described above.

Independently of whether the grooves 61, 62 are made by the embossing punches 57, 58 or by the rollers 71, 72, they run out in a gradual manner at their ends; this may be achieved by the oblique surfaces 76, 77 at the frontal faces of the embossing punches 57, 58 or by a corresponding positioning of the rollers 71, 72.

Thus, according to the invention, as part of the manufacturing process, the knitting tools 1 are stamped out from stock material, such as a steel ribbon. The stamped needle blanks 33 obtained in this manner are submitted to an embossing operation in which sharp edges, particularly burrs 37, obtained as a result of the stamping operation, are eliminated by a plastic deformation of the stamped blank 33. For example, in the manufacture of needle sawslots 6, the embossing operation precedes a cutting operation (such as milling) in the shaping sequence. In some instances, however, it is advantageous to first perform the milling operation and then submit the knitting tool to an embossing step. In such a case first a depression 61 is embossed in the blank, and the bottom of the depression 61 is subsequently removed by a cutting operation until the desired configuration of the depression is obtained. The rim of the depression appearing first by an embossing step is free from sharp edges without the need for subsequent machining, and also, a deburring is not required. The strengthening of the material achieved as a result of the embossing operation yields additional advantages.

It will be understood that the above description of the present invention is susceptible to various modifications, changes and adaptations, and the same are intended to be comprehended within the meaning and range of equivalents of the appended claims.

What is claimed is:

1. A method of making a knitting tool for a textile machine, comprising the following steps:

(a) stamping a knitting tool blank from stock material, wherein the stamped blank has, at an outer periphery thereof, one of a sharp burr and a sharp edge resulting from the stamping step; and (b) embossing the stamped blank for one of rounding and chamfering at least one of the sharp burr and the sharp edge, whereby at least one of the sharp burr and the sharp edge is at least partially eliminated by embossing; said embossing step comprising the step of pressing in at least one of the sharp burr and the sharp edge, and causing, in a region of said periphery, a flow of material within the blank towards a mid part thereof.

2. The method as defined in claim 1, wherein step (b) comprises the step of embossing regions of the stamped blank situated adjacent the regions to be chamfered or rounded.

3. The method as defined in claim 1, wherein step (b) is performed by an embossing tool; further wherein step (b) includes the step of transforming the stamped blank to an embossed blank having a cross-sectional contour determined by the embossing tool.

4. The method as defined in claim 1, wherein step (b) includes the step of cross-sectional area of the stamped blank, whereby flow of obtaining an essentially convex cross-sectional outline of the blank.

5. A method of making a knitting tool for a textile machine, comprising the following steps:

(a) stamping a knitting tool blank from stock material;

(b) embossing a groove into the knitting tool blank; said groove having at least in sections one of rounded and chamfered terminal flanks; and (c) after step (b) cutting one of a depression and a sawslot starting from said groove.

6. The method as defined in claim 5, wherein step (c) comprises the step of deepening said groove for forming parallel, mutually facing walls adjoining respective said terminal flanks.

7. The method as defined in claim 5, wherein step (b) is performed by one of an embossing punch and a profiled roller.

8. A stamped knitting tool for a textile machine comprising a stamped base body having a periphery and an embossed region along said periphery; said base body including (a) a blade having opposite, relatively wide side faces and relatively narrow top and bottom faces connecting the side faces with one another; and a first transitional zone between the top face and the side faces and between the bottom face and the side faces; said first transitional zone having embossed rounded edges; said embossed region including said first transitional zone; and (b) a butt formed on said blade as a one-piece component therewith and extending substantially perpendicularly thereto; said butt having an outline joining said blade by a second transitional zone having edges; said embossed region including said edges of said second transitional zone.

9. The stamped knitting tool as defined in claim 8, further comprising a head zone provided with a sawslot having a rim; said embossed region being provided at said sawslot and including at least partially said rim.

* * * * *